US005855768A

United States Patent [19]

Stanciulescu et al.

[11] Patent Number: 5,855,768

[45] Date of Patent: Jan. 5, 1999

[54] PROCESS FOR REMOVING CONTAMINANTS FROM THERMALLY CRACKED WASTE OILS

[75] Inventors: Maria Stanciulescu, Orleans; Michio Ikura, Kanata, both of Canada

[73] Assignee: Natural Resources Canada, Ottawa, Canada

[21] Appl. No.: 915,639

[22] Filed: Aug. 21, 1997

[51] Int. Cl.[6] ..... C10M 175/00

[52] U.S. Cl. ..... 208/180; 208/179

[58] Field of Search ..... 208/179, 180

[56] References Cited

U.S. PATENT DOCUMENTS

| | | | |
|---|---|---|---|
| 3,358,049 | 12/1967 | Schneider et al. | 260/674 |
| 3,799,869 | 3/1974 | Deed et al. | 208/211 |
| 3,819,508 | 6/1974 | Fainman et al. | 208/180 |
| 4,272,362 | 6/1981 | Schneider et al. | 208/254 |
| 4,399,025 | 8/1983 | Fletcher et al. | 208/180 |
| 4,405,448 | 9/1983 | Googin et al. | 208/262 |
| 4,582,591 | 4/1986 | Hoermeyer et al. | 208/45 |
| 4,597,882 | 7/1986 | Nishimura et al. | 208/180 |
| 4,746,420 | 5/1988 | Darian et al. | 208/222 |
| 5,336,840 | 8/1994 | Forte | 585/833 |
| 5,446,231 | 8/1995 | Arganbright et al. | 585/802 |

*Primary Examiner*—Helane Myers

[57] ABSTRACT

A process is described for removing contaminants from thermally cracked waste oil, e.g. used motor oil. In the process the cracked waste oil is contacted with a solvent comprising methanol. The thermally cracked waste oil is then separated from the solvent whereby a substantial portion of the contaminants are removed into the solvent. Thereafter, the solvent is separated from the contaminants and recycled.

4 Claims, 1 Drawing Sheet

PROCESS FOR REMOVING CONTAMINANTS FROM THERMALLY CRACKED WASTE OILS

BACKGROUND OF THE INVENTION

1. Field of the Invention

The present invention relates to a process for removing contaminants from thermally cracked waste oil, e.g. waste lubricating oil.

2. Description of the Prior Art

Numerous processes have been developed for producing diesel fuel from waste lubricating oil, referred to hereinafter as "used motor oil", by thermal cracking. However, the thermal cracking of used motor oils has serious problems with regard to product quality. Oil produced by thermal cracking of used motor oil has a strong odour, precipitates tar and darkens with time. All of these contribute to reduced marketability of the diesel fuel.

It is generally known that thermal cracking produces olefin-rich oil which rapidly changes colour and composition due to oxidation and polymerization reactions. This is described for instance in Balts, B. D. and Fathoni, A. Z., "A literature review on fuel stability studies with particular emphasis on diesel oil", Energy & Fuels, vol. 5, 2, 1991. That paper shows that cracked distillate tends to deteriorate more rapidly than straight run distillate during storage and that cracked products induce gum and sediment formation in fuels. Oxidation, auto-oxidation and chemical reactions, such as polymerization involving unsaturated hydrocarbons and/or reactive organic compounds of sulphur, nitrogen and oxygen present in the fuel are thought to be the major cause of gum or sediment formation.

Methanol extractions are described by Wechter, M. A. and Hardy, D. R., "The isolation of precursors responsible for insolubles formation in mid-distillate diesel fuels", Fuel Science and Technology Int'l, 7(4), 423–441 (1989). This article shows that when mid-distillate diesel fuels are extracted using methanol, insolubles in the fuel are reduced dramatically, with more than 95% of the fuel insolubles being soluble in methanol.

Sharma, Y. K, and Agrawal, K. M., "Influence of methanol extraction on the stability of middle distillate fuels", Fuel, 73(2), 269–271 (1994) also teaches about extractions with methanol. This article shows that when middle distillate fuels are extracted with methanol, the fuels form less insolubles, i.e. insolubles precursors are effectively removed.

Arganbright et al., U.S. Pat. No. 5,446,231, issued Aug. 29, 1995, describes a method for removing nitrile contaminants from $C_5$ streams in which methanol may be used as a solvent. Darian et al., in U.S. Pat. No. 4,746,420, issued May 24, 1988, have also found that methanol may be used as a co-solvent in the removal of nitrogen compounds from diesel oils.

It is the object of the present invention to find an improved process for the removal of contaminants from thermally cracked waste oil, such as used motor oil.

SUMMARY OF THE INVENTION

In accordance with the present invention, it has been found that contaminants may conveniently be removed from thermally cracked waste oil by intimately contacting a stream of the thermally cracked waste oil with a solvent comprising methanol. In the process, the thermally cracked waste oil is separated from the solvent whereby a substantial portion of the contaminants are removed into the solvent. Thereafter, the solvent is separated from the contaminants and recycled.

Although the process of the invention is of particular interest for thermally cracked used motor oil, it is also useful for treating other thermally cracked waste oils, such as thermally cracked waste plastic oil and oil shale. The used motor oil may be mineral or synthetic, with a typical boiling range of about 180° C. to 460° C.

It is particularly advantageous according to this invention to carry out the solvent extraction within a short time and preferably within 24 hours after the thermally cracking of the used motor oil. Within 24 hours, the solvent extraction improves and stabilizes the colour. However, if the cracked oil is left for more than 24 hours, it develops a dark colour that cannot be improved. It is also particularly preferred to use the methanol solvent while substantially free from water and to treat the thermally cracked used motor oil as received from thermal cracking without added diluents or other additives.

Used motor oils typically contain substantial amounts of chlorine which result from contamination with chlorinated solvents used for motor cleaning. The process of the invention has also been found to be highly effective in reducing the chlorine content.

Another problem with thermally cracked used motor oil is its very high acidity, e.g. 0.2–0.6 mg KOH/g, making it unsuitable as a fuel. The process of the invention also greatly lowers the acidity.

The process is preferably carried out with a weight ratio of cracked motor oil to methanol solvent of from about 1:4 to about 4:1. A ratio of 1:1 is particularly preferred.

The extraction is carried out at a temperature below the boiling point of the solvent and typically at a temperature between room temperature and 60° C. The process may be carried out at atmospheric pressure with a contact time of typically between about 5 and 40 minutes.

The contact between the solvent and the oil may be carried out in a batch mixer or by continuous counter current or cross flow configurations.

Using the process of the present invention, thermally cracked used motor oils can be obtained with residues in the range of 5 to 150. The result is that discolouration (blackening of the processed oil) during storage is stopped and foul odours issuing from the oil are greatly reduced. Furthermore, acidity of the processed oil is decreased to a detection limit and tar precipitation during storage is prevented. The contents of sulphur, nitrogen and chlorine in the oil are all significantly reduced with the process of the invention, with sulphur being decreased by 60%, nitrogen by 90% and chlorine by 60%.

DESCRIPTION OF THE PREFERRED EMBODIMENTS

Figure 1:
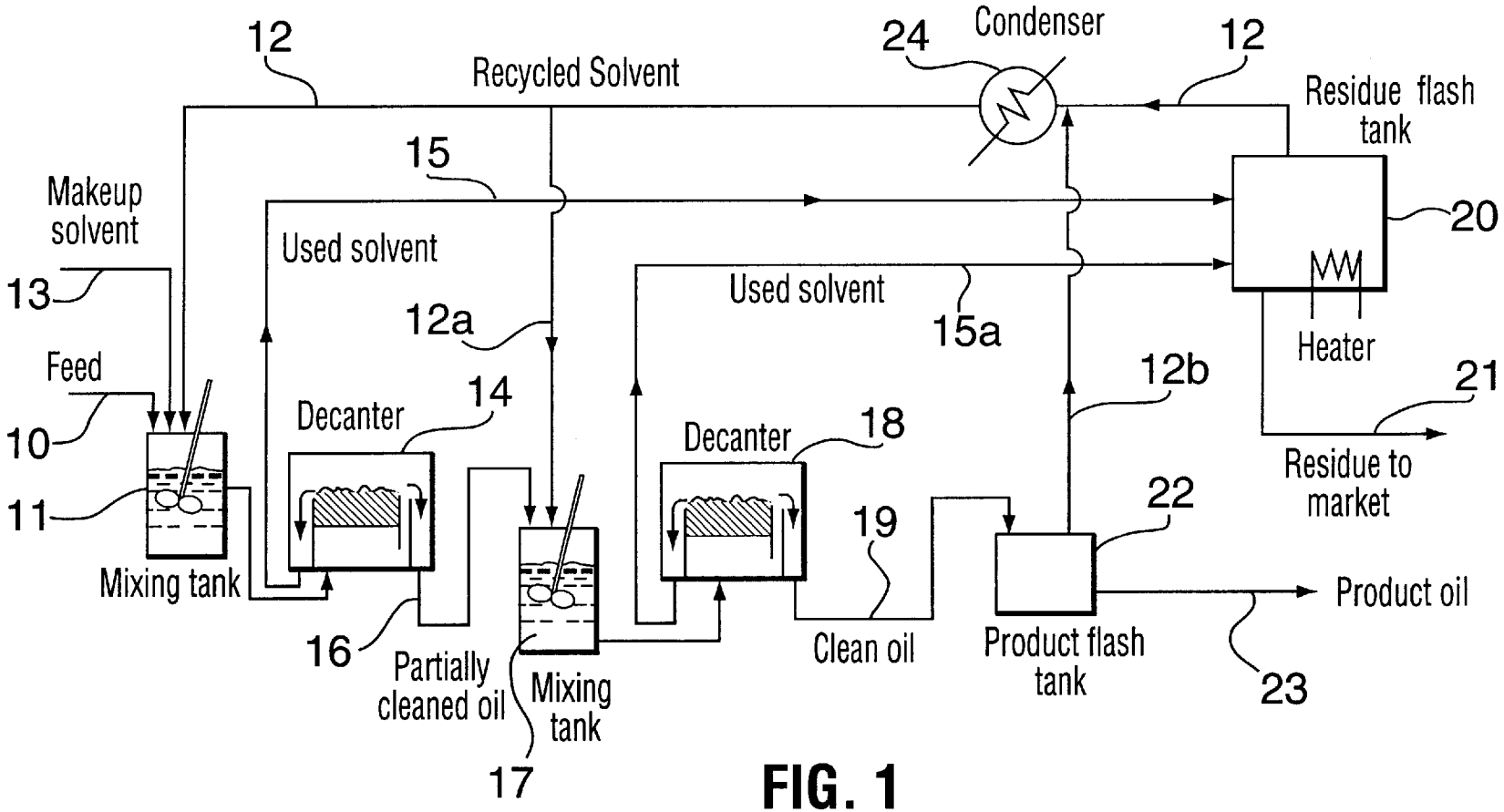
FIG. 1 is a simplified flow diagram of a liquid—liquid extraction process according to the invention.

FIG. 1 shows a schematic flow sheet for a continuous extraction unit.

Thermally cracked used motor oil 10 is pumped into a first mixing tank 11 where it is mixed with clean recycled methanol 12. If required, some additional make up methanol 13 may be added.

The resulting mixtures overflows by gravity from the bottom of the first mixing tank 11 into a first decanter 14. Contaminated methanol 15 floats to the top of the decanter and is withdrawn to a flash tank 20. Partially cleaned oil 16 exits the first decanter 14 through an underflow weir to a second mixing tank 17 where it is again mixed with clean recycled methanol 12*a*. Contaminated methanol 15*a* again floats to the top of the second decanter 18 and then flows into flash tank 20. Cleaned oil 19 leaves the second decanter 18 through an underflow weir. The clean oil passes through a product flash tank 22 from which product oil 23 is collected and further solvent 12*b* is recycled to recycle line 12.

In flash tank 20 clean solvent 12 is flashed off and a residue 21 is collected. Evaporated methanol vapours 12 pass through a light ends condenser 24 for condensing the methanol into liquid form for recycle.

In a typical operation, the methanol leaves the flash tank 20 at a temperature of about 75° C. and the condenser 24 is operated at a temperature of about 55° C.

The quality of the waste motor oil, and thus the quality of the thermally cracked oil, varies greatly depending on the collectors and locations. A variety of samples of cracked waste motor oils are shown in Table 1 below.

TABLE 1

| Characteristics | Sample 1 | Sample 2 | Sample 3 | Sample 4 | Sample 5 |
|---|---|---|---|---|---|
| IBP, °C. | 69 | 150 | 40 | 160 | 140 |
| FBP, °C. | 459 | 460 | 420 | 460 | 462 |
| Density, kg/m$^3$ | 845.9 | 850.1 | 844.6 | 847.8 | 866.2 |
| ASTM colour | 4 | 7 | 4.5 | 7.5 | 5.5 |
| Acidity, mg KOH/g | 0.6 | 0.2 | — | — | 0.558 |
| Sulphur, wt % | 0.19 | 0.14 | 0.25 | 0.24 | 0.51 |
| Nitrogen, ppm | 524 | 637 | 521 | 431.9 | 184 |
| Chlorine, ppm | 137 | 78 | 187 | 270 | 617 |
| Flash point, °C. | 8 | — | <0 | 33.9 | — |

EXAMPLE 1

As thermally cracked used motor oil, Sample 1 from Table 1 was used. 235 Grams of this oil were mixed with 54 grams of methanol. The mixing was carried out manually in a separating funnel for a period of 5 minutes. The resulting mixture was then left to separate into two phases for 5 minutes. The upper phase was methanol laden with impurities and the lower phase was partially cleaned oil. The extraction of the partially cleaned oil was repeated a further 3 times using fresh methanol each time to simulate a four-stage operation. The test results are shown in Table 2.

EXAMPLE 2

A further batch procedure was carried out, this time with a mixture of 186 grams of the thermally cracked oil (Sample 1) and 93 grams of methanol. Once again, these were mixed manually in a separating funnel for 5 minutes. The resulting mixture was left to separate into two phases for 5 minutes, with the upper phase being methanol laden with impurities and the lower phase being partially cleaned oil. The extraction of the partially cleaned oil was repeated once more using fresh methanol to simulate a two-stage operation. The test results are shown in Table 2.

EXAMPLE 3

For this test the thermally hydrocracked used motor oil was Sample 2 from Table 1. An extraction was carried out using the system of FIG. 1. In this procedure, 805 grams of oil were processed over a period of 5 hours and 20 minutes. The results are shown in Table 2.

EXAMPLE 4

The procedure of Example 3 was repeated, using a topped Sample 3 from Table 1. It had the following characteristics:

IBP=150° C.

FBP=460° C.

Density=850.1 kg/m$^3$

ASTM colour=4.5

Sulphur=0.14 wt %

Nitrogen=431 ppm

Chlorine=69 ppm

Acid number=NA

Flash point=NA

In this case, 919 grams of oil was processed in a period of 5 hours and 45 minutes. Again, the results are shown in Table 2.

TABLE 2

Summary of experimental results

| Oil | Process mode | Clean oil yield | Colour | Odour | Tar | Sulphur | nitrogen | Chlorine | Acid number |
|---|---|---|---|---|---|---|---|---|---|
| Feed A | | | 4 | Foul Smelled | Yes | 0.19% | 524 ppm | 137 ppm | 0.60 mg/g |
| Processed A | Batch | 93.7% | 3 | Smell reduced | No | 0.10% | 63 ppm | 53 ppm | 0.04 mg/g |
| Feed B | | | 6 | Foul Smell | Yes | 0.14% | 637 ppm | 78 ppm | 0.20 mg/g |
| Processed B | Batch | 90.9% | 3 | Smell Reduced | No | 0.11% | 132 ppm | 47 ppm | 0.06 mg/g |
| Processed B | Continuous | 95.2% | 4.5 | Smell reduced | No | 0.08% | 141 ppm | 61 ppm | ///// |
| Feed C | | | 4.5 | Foul smell | Yes | 0.14% | 431 ppm | 69 ppm | ///// |
| Processed C | Continuous | 94.7% | 3.5 | Smell reduced | No | 0.11% | 135 ppm | ///// | 0.03 mg/g |

Note:
Acid number is an amount of KOH (mg) required to neutralize one gram of oil. The detection limit of acid number is 0.05 mg/g.
Residues yield can be calculated from 100% - clean oil yield.

We claim:

1. A process for removing contaminants from thermally cracked used motor oil comprising:

(a) intimately contacting a stream of thermally cracked used motor oil with a solvent comprising methanol which is substantially free from water, the thermally cracked used motor oil being as-cracked without added diluents or additives;

(b) separating the thermally cracked used motor oil from the solvent whereby a substantial portion of the contaminants are removed to the solvent;

(c) separating the solvent from the contaminants; and (d) recycling the solvent.

2. The process of claim 1 wherein the solvent extraction is carried out within 24 hours after thermal cracking of the used motor oil.

3. The process of claim 2 wherein the weight ratio of cracked motor oil to methanol solvent is from about 1:4 to about 4:1.

4. The process of claim 2 wherein the weight ratio of cracked used motor oil to methanol solvent is about 1:1.

* * * * *